United States Patent [19]

Barneck

[11] Patent Number: 5,054,558

[45] Date of Patent: Oct. 8, 1991

[54] EQUALIZING BLANK VALVE APPARATUS AND METHODS

[76] Inventor: Michael R. Barneck, Rte. 1, Box 1538, Roosevelt, Utah 84066

[21] Appl. No.: 518,446

[22] Filed: May 4, 1990

[51] Int. Cl.[5] ..... E21B 23/03; E21B 34/14; E21B 43/12

[52] U.S. Cl. ..... 166/373; 166/117.5; 166/317; 166/385; 166/386

[58] Field of Search ..... 166/117.5, 317, 332, 166/322, 324, 321, 373, 385, 386

[56] References Cited

U.S. PATENT DOCUMENTS

| | | | |
|---|---|---|---|
| 2,626,177 | 1/1953 | Maxwell et al. | 166/317 X |
| 2,949,963 | 8/1960 | McGowen, Jr. et al. | 166/317 |
| 3,070,119 | 12/1962 | Raulins | 166/322 X |
| 3,378,079 | 4/1968 | Page, Jr. | 166/322 X |
| 3,627,042 | 12/1971 | McGowen, Jr. et al. | 166/322 |
| 3,980,135 | 9/1976 | Garrett | 166/332 |
| 4,066,128 | 1/1978 | Davis et al. | 166/373 |
| 4,359,094 | 11/1982 | Risinger | 166/317 |
| 4,483,397 | 11/1984 | Gray | 166/250 |
| 4,527,631 | 7/1985 | Vazquez | 166/322 |
| 4,651,822 | 3/1987 | Johnston et al. | 166/117.5 |

OTHER PUBLICATIONS

Teledyne Merla, *Gas Lift Valves*, (U.S.A.).

*Primary Examiner*—Stephen J. Novosad
*Attorney, Agent, or Firm*—Berne S. Broadbent

[57] ABSTRACT

An equalizing blank valve apparatus for use in a side-pocket mandrel in an underground well. The apparatus comprises a first body member and a second body member. The first body has a chamber therein, and the second body member has a proximal end, a distal end, a first orifice located proximate said proximal end, a second orifice located proximate said distal end, and a passageway therethrough communicating with the said first and second orifices. The second body member is configured such that said proximal end of the second body member and said first orifice are telescopically insertable into the chamber in the first body member. Means cooperating with the first and second body members is provided for substantially sealing said first orifice when said first orifice is inserted into the chamber in the first body member. Means is also provided for preventing said proximal end of the second body member from being removed from the chamber in the first body member.

11 Claims, 3 Drawing Sheets

EQUALIZING BLANK VALVE APPARATUS AND METHODS

BACKGROUND

1. The Field of the Invention

This invention relates to valves for use in sidepocket mandrels in underground wells and, more particularly, to novel equalizing blank valve apparatus and methods for equalizing a pressure differential between the tubing and the casing of a well.

2. The Background Art

Underground wells are typically constructed so as to include a large pipe called the "casing" which extends into the earth the entire length of the well. The casing helps ensure the mechanical integrity of the well so as, for example, to keep oil and gas from contaminating adjacent water supplies. Perforations are provided through the casing at the levels of various zones in the earth containing oil or gas. Packers are also provided within the casing to isolate these zones from the upper portion of the well and also to isolate adjacent zones from each other.

A typical well structure also comprises a smaller pipe called the "tubing." The tubing is installed within the casing so as to pass through the packers and also extend the entire length of the well. In oil or gas producing wells, it is typically the tubing which conveys the oil or gas to the wellhead. Similarly, the tubing is commonly used to convey injection material into injection wells.

In order to permit communication between the tubing and the casing, sidepocket mandrels are installed as part of the tubing string. Each mandrel typically has a port which communicates with the casing, and an adjacent sidepocket is provided for installing a valve mechanism. Such valves thus allow for controlled communication between the tubing and the casing annulus surrounding the tubing at the various zone levels at which the sidepocket mandrels are installed. Thus, for example, a sidepocket mandrel may be provided with an orifice injection valve for the injection of water, corrosion inhibitors or other materials into the various zones of injection wells. Similarly, gas lift valves may be installed in the sidepocket mandrels in producing wells so as to carry out conventional gas lift methods.

A wireline running tool is usually employed to install a valve in a sidepocket mandrel. The running tool attached to the wireline is used to lower the valve into a sidepocket mandrel, and a latch mechanism is provided on the valve to lock the valve into place in the mandrel.

When it is subsequently desired to remove a valve from a sidepocket mandrel, a wireline is again run into the well to the level of the valve. A pulling tool attached to the end of the wireline is then used to secure the end of the valve latch. An upward jarring on the wireline then shears a pin in the latch mechanism, thereby releasing the valve from the sidepocket mandrel and allowing it to be removed by the wireline from the well.

Quite frequently, it is desireable that there be no communication between a particular mandrel and the surrounding casing annulus. Such is, for example, often the case in a mandrel which is located at the bottom of a deep well. It is also sometimes desireable to preclude such communication at various selected zones along the length of the well.

To prevent any communication between a mandrel and the surrounding casing annulus, a "blank" or "dummy" valve is typically employed. Dummy valves are basically a solid metal plug which has substantially the same size and configuration as a valve. The dummy valve is also provided with a latch mechanism to latch it into the sidepocket mandrel in the manner described above.

It will be readily appreciated that there is often a very large pressure differential between the tubing and the surrounding casing annulus. This pressure differential may, for example, sometimes be as great as 2,000 pounds per square inch or more. Significantly, such large pressure differentials may make it difficult, if not impossible, to subsequently remove a dummy valve which has been installed in a sidepocket mandrel in a well.

To facilitate the removal of dummy valves in cases of anticipated large pressure differentials, equalizing dummy valves have been developed. Such valves allow the pressure between the tubing and casing to be equalized before the valve is pulled, thereby making valve retrieval much easier.

Prior art equalizing dummy valves typically include a special latch mechanism. This latch includes a separate prong or "fishing head" at the top which may be pulled so as to equalize pressure between the tubing and casing. Once this prong is pulled, a tool may then be lowered by a wireline so that the valve may be released from the sidepocket mandrel and pulled from the well.

Although prior art equalizing dummy valves afford significant advantages over the use of a solid metal plug, significant disadvantages remain. For example, the need for a special latch for equalizing dummy valves significantly increases the cost and confusion at a well site due to the need to stock and use different valve latches for different situations. Moreover, special tools are typically required both to install and to retrieve prior art equalizing dummy valves. This likewise increases the cost associated with installing and maintaining such valves.

In addition, in order to retrieve a prior art equalizing dummy valve from a sidepocket mandrel, two separate wireline runs are typically required. A first run lowers the special tool which is designed to pull the equalizing fishing head on the latch mechanism of the equalizing dummy valve. A second wireline run is then required to lower the tool needed to unlatch the equalizing dummy valve from the sidepocket mandrel and raise the valve to the earth's surface. It will be readily appreciated that the necessity of making two separate wireline runs to retrieve a single valve may be a significant disadvantage, particularly in view of the fact that such valves may be located several thousand feet below the earth's surface.

BRIEF SUMMARY AND OBJECTS OF THE INVENTION

In view of the foregoing, it is a primary object of the present invention to provide an equalizing blank valve apparatus and method which may be used with standard valve latch mechanisms.

It is also an object of the present invention to provide an equalizing blank valve apparatus which is capable of being installed and retrieved using standard wireline tools.

Further, it is an object of the present invention to provide an equalizing blank valve apparatus and method which requires only a single wireline run in order to equalize the pressure differential between the tubing and the casing and retrieve the valve from a well.

It is a still further object of the present invention to provide an equalizing blank valve apparatus which may be used in both injection and gas lift wells.

Consistent with the foregoing objects, and in accordance with the invention as embodied and broadly described herein, an equalizing blank valve apparatus is disclosed in one embodiment of the present invention as including a first body member and a second body member. The first body member has a chamber therein and the second body member has a first orifice, a second orifice, and a passageway therethrough communicating with the said first and second orifices.

The second body member is configured such that a portion of the second body member, including said first orifice, is slidably insertable into the chamber in the first body member. Means cooperating with the first and second body members is also provided for substantially sealing said first orifice when said portion of the second body member including the first orifice is inserted into the chamber in the first body member.

After an equalizing blank valve apparatus consistent with the present invention is installed in a sidepocket mandrel in an underground well, a pressure differential between the well tubing and casing can be equalized by first latching onto the equalizing blank valve apparatus with a conventional wireline valve pulling tool. Then, by jarring the equalizing blank valve apparatus upward with the wireline valve pulling tool, the said first orifice can be made to slide out of the chamber in said first body member, thereby exposing the orifice and allowing communication between the tubing and the casing.

BRIEF DESCRIPTION OF THE DRAWINGS

The foregoing and other objects and features of the present invention will become more fully apparent from the following description and appended claims, taken in conjunction with the accompanying drawings. Understanding that these drawings depict only typical embodiments of the invention and are, therefore, not to be considered limiting of its scope, the invention will be described with additional specificity and detail through use of the accompanying drawings in which:

DETAILED DESCRIPTION OF THE PREFERRED EMBODIMENT

It will be readily understood that the components of the present invention, as generally described and illustrated in the Figures herein, could be arranged and designed in a wide variety of different configurations. Thus, the following more detailed description of the embodiment of the apparatus and method of the present invention, as represented in FIGS. 1 through 6, is not intended to limit the scope of the invention, as claimed, but it is merely representative of the presently preferred embodiment of the invention.

The presently preferred embodiment of the invention will be best understood by reference to the drawings, wherein like parts are designated by like numerals throughout.

Figure 1:
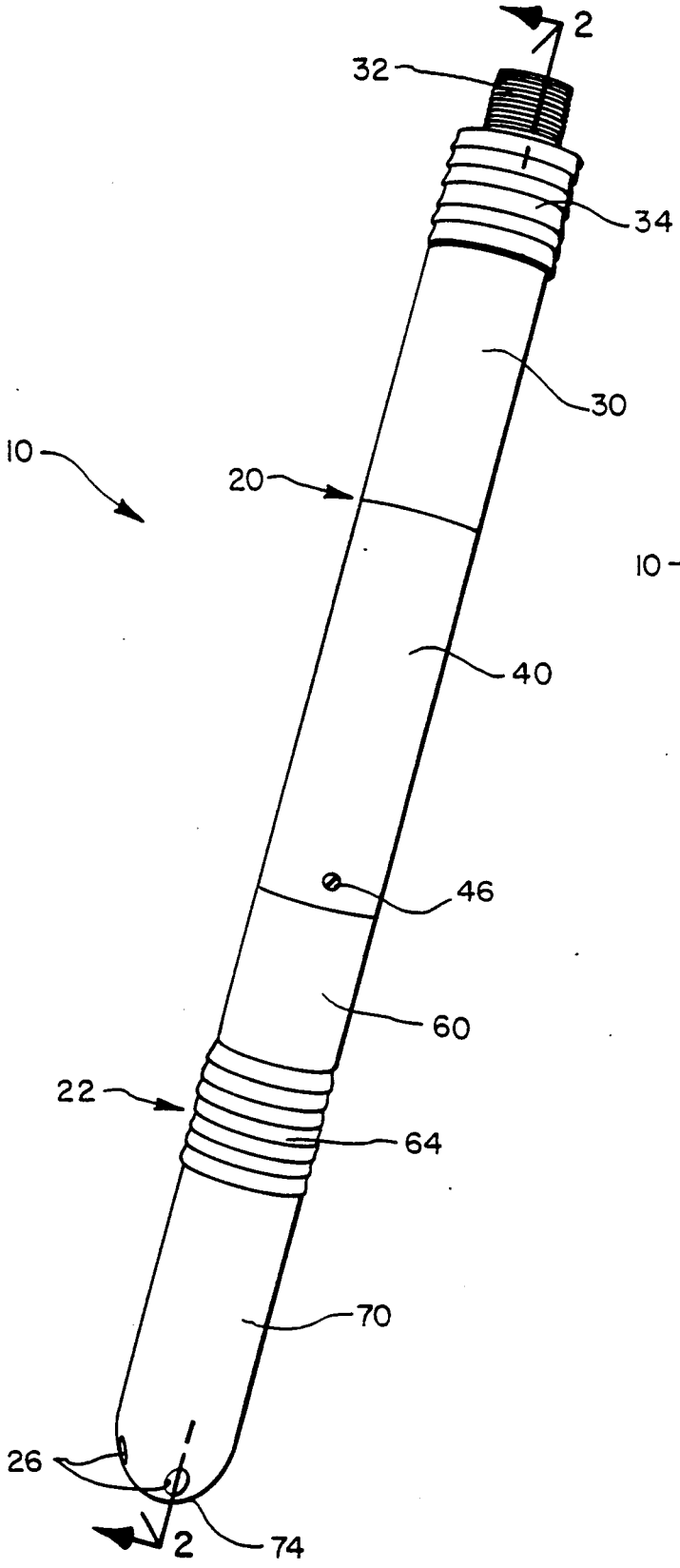
FIG. 1 is a perspective view illustrating one presently preferred embodiment of the equalizing blank valve apparatus of the present invention.
Figure 3:
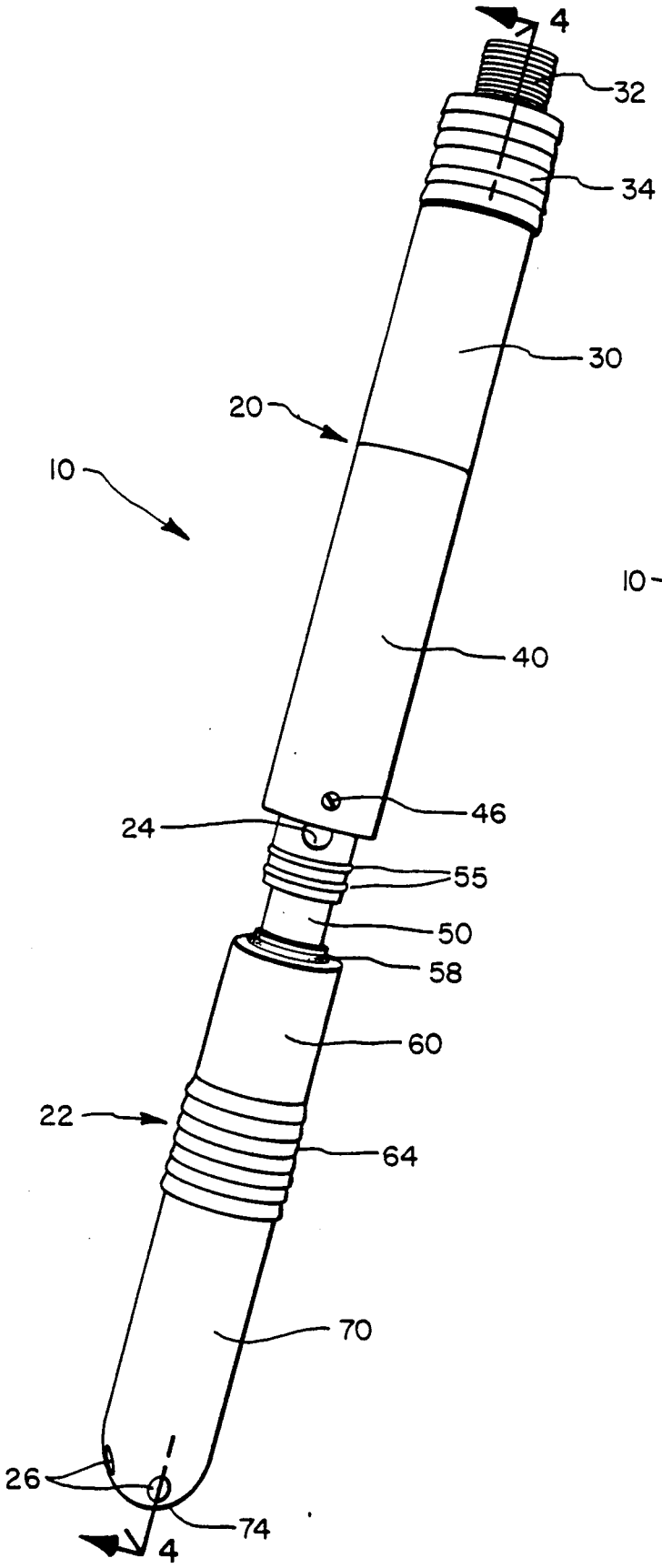
FIG. 3 is a perspective view of the embodiment of FIG. 1 showing the valve equalizing orifice retracted and exposed.

The equalizing blank valve apparatus of the present invention, generally designated at 10, is shown in its entirety in FIGS. 1 and 3. As shown, equalizing blank valve 10 comprises two body members 20 and 22, an upper portion of body member 22 being telescopically inserted into body member 20. When body member 22 is fully inserted into body member 20, as depicted in FIG. 1, equalizing blank valve 10 is closed and functions essentially like a solid metal plug. On the other hand, when body member 22 is fully retracted from body member 20, as depicted in FIG. 3, an equalizing orifice 24 is exposed through which pressure may be equalized between the tubing and the casing of a well, as discussed in more detail below.

The specific construction of one presently preferred embodiment of the equalizing blank valve 10 of the present invention may be best understood by reference to FIGS. 1 through 4. As shown, first body member 20 of equalizing blank valve 10 may be formed in two sections, designated 30 and 40. Similarly, second body member 22 of equalizing blank valve 10 may be formed in three sections, designated 50, 60, and 70.

Section 30 of first body member 20 is formed with threads 32 such that equalizing blank valve 10 may be provided with a conventional valve latch mechanism (not shown). Section 30 is also provided with a conventional sealing means 34 for forming a seal between equalizing blank valve 10 and a sidepocket mandrel into which equalizing blank valve 10 is installed. Section 30 further includes male threads 36 which are receivable into corresponding female threads in section 40, whereby section 30 may be secured to section 40, as shown.

Section 40 of first body member 20 defines an open chamber 42. Importantly, for reasons which will become apparent from the discussion that follows, chamber 42 is formed with an inwardly projecting shoulder 43.

Section 40 of first body member 20 also includes a smooth, seal seating surface 44 immediately below shoulder 43 in chamber 42. Section 40 is also provided with suitable holes through which one or more shear screws 46 may be inserted (see FIG. 2), as will be described further below.

Still referring to FIGS. 1 through 4, top section 50 of second body member 22 is formed such that a portion 52 of section 50 may be telescopically received inside chamber 42 of first body member 20. The proximal end 53 of section 50 is formed as a stop ring, as shown, thereby cooperating with shoulder 43 in chamber 42 to prevent the removal of section 50 from chamber 42, as shown best in FIG. 4.

Figure 2:
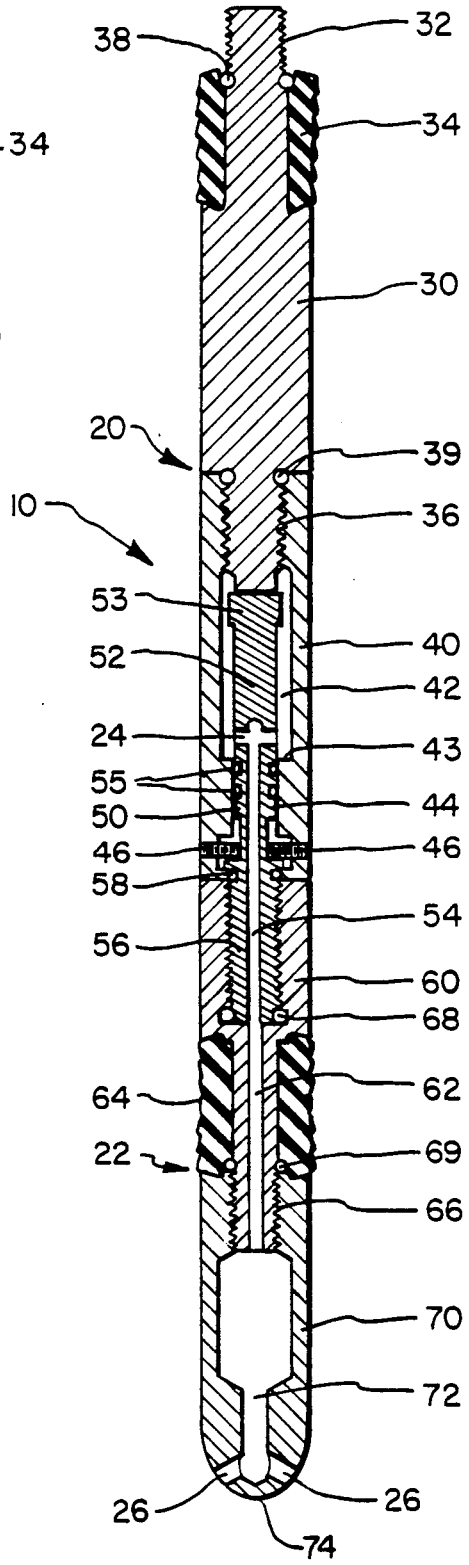
FIG. 2 is a vertical cross-sectional view of the embodiment of FIG. 1 taken along lines 2—2 of FIG. 1.
Figure 4:
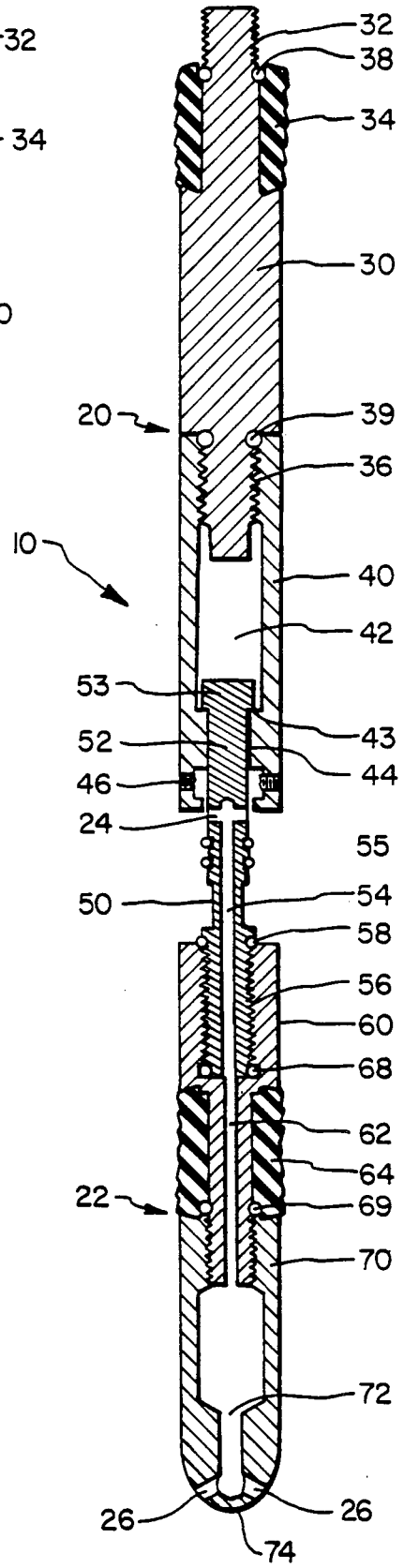
FIG. 4 is a vertical cross-sectional view taken along lines 4—4 of FIG. 3.

Section 50 of second body member 22 has one or more orifice 24 therein. Orifice 24 may, for example, be formed by means of a throughbore through section 50, as depicted in FIGS. 2 and 4. A conduit or passageway 54 is also provided in section 50, conduit 54 communicating with orifice 24 and extending through the bottom of section 50, as shown.

One or more O-rings 55 is provided surrounding section 50 of second body member 22 immediately below orifice 24. As illustrated in FIG. 2, O-rings 55 form a seal in cooperation with seating surface 44 of first body member 20 when second body member 22 is fully inserted into the chamber 42 in first body member 20. Male threads 56 are provided on section 50 for connecting section 50 to section 60, as shown.

Section 60 of second body member 22 also includes a conduit or passageway 62 which forms a continuation of conduit 54 of section 50. Section 60 is also configured so as to receive a conventional sealing means 64, which, like sealing means 34 mentioned above, forms a seal in conventional fashion between equalizing blank valve 10 and a sidepocket mandrel into which equalizing blank valve 10 is installed. Section 60 is secured to section 70 of second body member 22 by means of male threads 66 which are insertable in corresponding female threads in section 70.

Bottom section 70 of second body member 22 also includes a conduit or passageway 72 which is a continuation of conduits 54 and 62 described above. Conduit 72 in section 70 terminates adjacent the distal end 74 of section 70 in one or more orifices 26.

To insure the sealing of any openings between sections 30, 40, 50, 60, and 70 of first and second body members 20 and 22, additional O-ring seals may be provided, such as, for example, the O-ring seals illustrated at 38, 39, 58, 68, and 69. It will readily appreciated, however, that a tight fit between the various sections of first and second body members 20 and 22 may render such additional O-ring seals unnecessary.

Equalizing blank valve 10 is illustrated herein as being substantially cylindrical in shape. This is consistent with the current shape of the valves which are typically installed in sidepocket mandrels in wells. It will be readily appreciated, however, that equalizing blank valve 10 may have virtually any suitable shape.

Similarly, equalizing blank valve 10 may have any appropriate size. Consistent with the sidepocket mandrels most commonly used in wells, equalizing blank valve 10 may, for example, be approximately 13 inches (33 cm) in length when fully extended as depicted in FIGS. 3 and 4. Equalizing blank valve 10 may likewise be either 1 inch (2.5 cm) or 1.5 inch (3.8 cm) in diameter, consistent with the most typical sizes of valve pockets in current sidepocket mandrels.

A number of suitable materials might be used in constructing the equalizing blank valve 10 of the present invention. Sections 30, 40, 50, 60, and 70 of equalizing blank valve 10 might, for example, be formed of hardened steel, with seals 34 and 64, together with the various O-ring seals described herein, being formed of rubber. Other suitable materials may, of course, be used consistent with the objects and features of the present invention.

In use, equalizing blank valve 10 is first assembled by inserting section 50 of second body member 22 through the open top end of section 40 of first body member 20 such that stop ring 53 resides within chamber 42 in section 40 and threads 56 of section 50 extend out of the bottom of section 40, as shown in FIGS. 2 and 4. Section 30 may then be attached to section 40, as illustrated herein, and sealing means 34 may be placed on the end of section 30.

Section 60 of second body member 22 may then be attached by means of threads 56 to section 50. Then, after sealing means 64 is placed on section 60, section 60 may be connected to section 70.

When thus assembled, conduits 54, 62, and 72 form a continuous conduit or passageway through second body member 22, whereby orifices 24 are in direct communication with orifices 26. Unrestricted communication between orifices 24 and 26 is, however, only possible when second body member 22 is fully retracted from first body member 20, as illustrated in FIGS. 3 and 4. When second body member 22 is fully inserted in first body member 20, as depicted in FIGS. 1 and 2, O-rings 55 cooperate with seating surface 44 to effectively seal orifices 24.

Prior to inserting equalizing blank valve 10 into a well, second body member 22 of equalizing blank valve 10 is fully inserted into first body member 20 and secured by means of set screws 46 (see FIGS. 1 and 2). Set screws 46 may be formed of any suitable material, such as, for example, brass.

A conventional latch mechanism (not shown) is then connected to equalizing blank valve 10 in conventional fashion using threads 32, and equalizing blank valve 10 may be installed in a sidepocket mandrel using conventional wireline tools.

Figure 5:
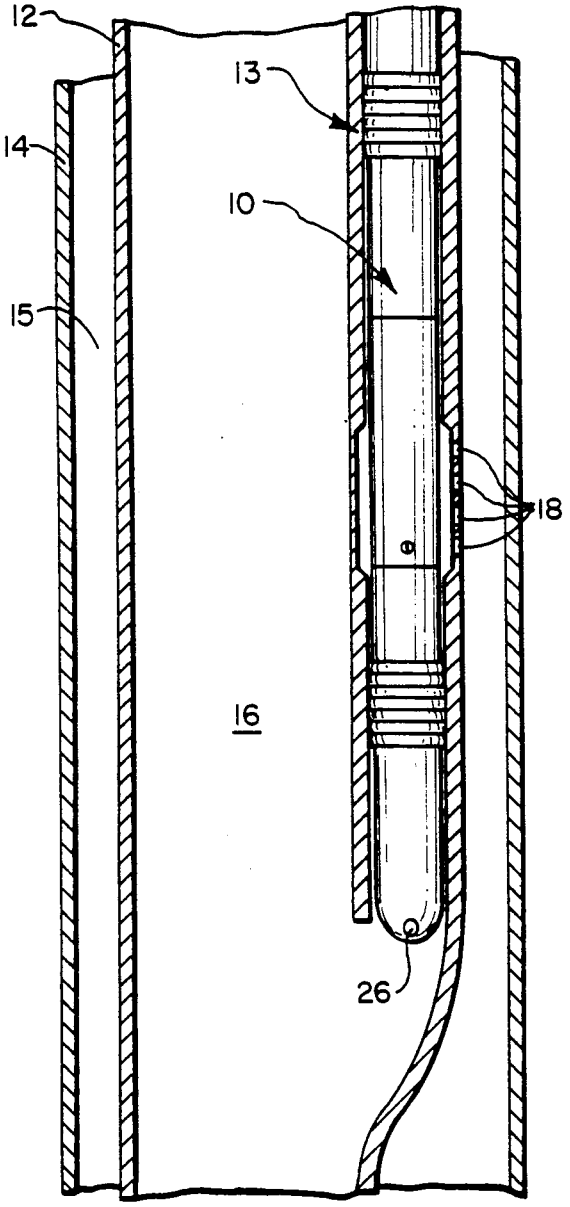
FIG. 5 is a partial cross-sectional view illustrating one presently preferred embodiment of the equalizing blank valve apparatus of the present invention installed in a sidepocket mandrel in a well, the equalizing blank valve apparatus being shown in its closed position.

Referring now to FIG. 5, when equalizing blank valve 10 is installed as outlined above in the sidepocket 13 of a sidepocket mandrel 12, ports 18 in mandrel 12 are effectively sealed by equalizing blank valve 10. Therefore, as desired, there is initially no communication between tubing space 16 and the surrounding annulus 15 within casing 14.

When it is later decided to retrieve equalizing blank valve 10 from mandrel 12, a standard wireline valve pulling tool may be inserted into the well. Equalizing blank valve 10 may then be located and latched in conventional fashion.

Figure 6:
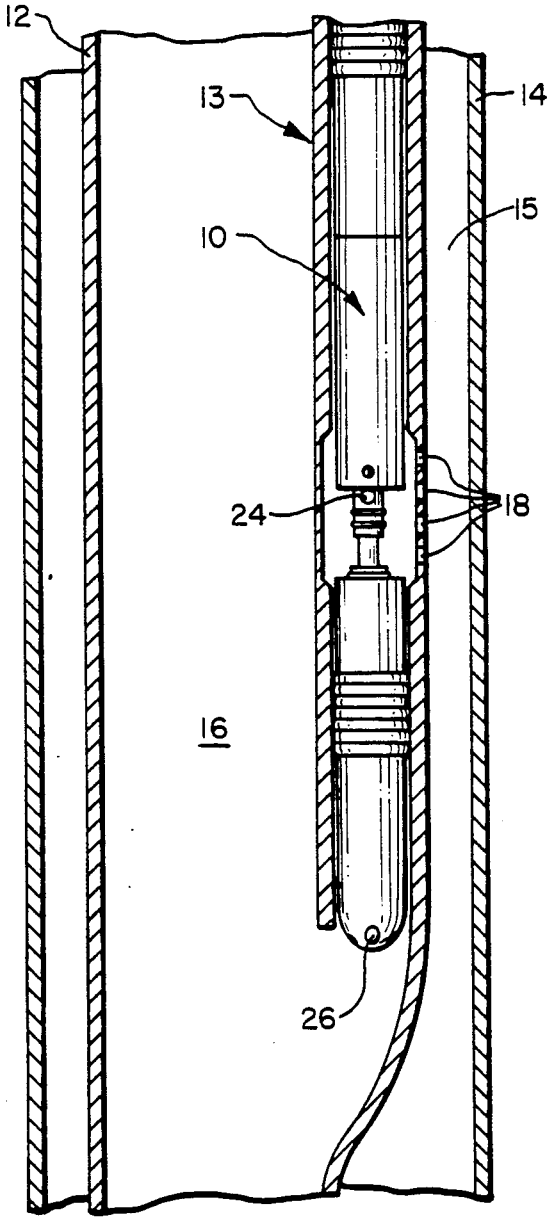
FIG. 6 is a partial cross-sectional view similar to FIG. 5, the equalizing blank valve apparatus being shown in its open position.

Significantly, if a pressure differential between tubing space 16 and annulus 15 makes it difficult to pull equalizing blank valve 10, an upward jarring pressure may be exerted through the wireline tool so as to shear screws 46 (see FIGS. 2 and 4) and allow equalizing blank valve 10 to scope apart, as depicted in FIG. 6. Orifice 24 of equalizing blank valve 10 is then exposed, thereby allowing the pressure differential between tubing space 16 and annulus 15 to be equalized through ports 18 and orifices 24 and 26. Once the pressure is equalized, equalizing blank valve 10 may then be readily removed in conventional fashion.

From the above discussion, it will be appreciated that the present invention provides an equalizing blank valve apparatus and method which may be used with standard valve latch mechanisms and which are suited for use in both injection and gas lift wells. Unlike prior art equalizing dummy valves, the present invention also provides an equalizing blank valve apparatus which is capable of being installed and retrieved using standard wireline tools.

Additionally, the present invention provides an equalizing blank valve apparatus and method which requires only a single wireline run in order to both equalize the pressure differential between the tubing and the casing and retrieve the valve from a well. The present invention thus provides significant advantages over prior art dummy valves now in use.

The present invention may be embodied in other specific forms without departing from its spirit or essential characteristics. The described embodiments are to be considered in all respects only as illustrative, and not restrictive. The scope of the invention is, therefore, indicated by the appended claims, rather than by the foregoing description. All changes which come within the meaning and range of equivalency of the claims are to be embraced within their scope.

What is claimed and desired to be secured by United States Letters Patent is:

1. An equalizing blank valve apparatus, comprising:

a first body member having a chamber therein;

a second body member having a first orifice, a second orifice, and a passageway therethrough communicating with the said first and second orifices, the second body member being configured such that a portion of the second body member including said first orifice is slidably insertable into the chamber in the first body member;

means cooperating with the first and second body members for substantially sealing said chamber in the first body member around said portion of the second body member including the first orifice when said portion of the second body member is inserted into the chamber in the first body member, thereby effectively sealing said first orifice and preventing unrestricted communication between said first and second orifices; and means for maintaining said first orifice inside the chamber in the first body member, the means for maintaining said first orifice inside the chamber comprising a shear screw passing through the first body member and engaging the second body member.

2. An equalizing blank valve apparatus for use in a sidepocket mandrel in an underground well, the apparatus comprising:

a first body member having a chamber therein;

a second body member having a proximal end, a distal end, a first orifice located proximate said proximal end, a second orifice located proximate said distal end, and a passageway therethrough communicating with the said first and second orifices, the second body member being configured such that said proximal end of the second body member and said first orifice are telescopically insertable into the chamber in the first body member;

means cooperating with the first and second body members for substantially sealing said chamber in the first body member around said proximal end and first orifice of the second body member when said proximal end and first orifice are inserted into the chamber in the first body member, thereby effectively sealing said first orifice and preventing unrestricted communication between said first and second orifices; and means for preventing said proximal end of the second body member from being removed from the chamber in the first body member.

3. An equalizing blank valve apparatus as defined in claim 2 further comprising means for maintaining said first orifice inside the chamber in the first body member.

4. An equalizing blank valve apparatus as defined in claim 3 wherein the means for maintaining said first orifice inside the chamber comprises a shear screw passing through the first body member and engaging the second body member.

5. An equalizing blank valve apparatus as defined in claim 3 wherein the means for substantially sealing said chamber comprises a resilient member positioned on the second body member such that said resilient member engages and substantially seals the chamber in the first body member when said first orifice is inserted into the chamber.

6. An equalizing blank valve apparatus as defined in claim 5 wherein the chamber is formed with an inwardly projecting shoulder, and wherein said means for preventing said proximal end of the second body member from being removed from the chamber comprises a stop ring formed adjacent the proximal end of the second body member.

7. An equalizing blank valve apparatus as defined in claim 2 further comprising means associated with the first and second body members for forming a seal between the first and second body members and said sidepocket mandrel.

8. An equalizing blank valve apparatus as defined in claim 7 wherein the first and second body members are substantially cylindrical in shape.

9. An equalizing blank valve apparatus as defined in claim 8 wherein the first body member is formed with male threads for use in attaching a sidepocket mandrel valve latch mechanism.

10. A method for equalizing a pressure differential between a tubing and a casing in an underground well, the method comprising the steps of:

installing an equalizing blank valve apparatus in a sidepocket mandrel in the well, the sidepocket mandrel forming a part of the tubing, the equalizing blank valve apparatus comprising:

a first body member having a chamber therein;

a second body member having a first orifice, a second orifice, and a passageway therethrough communicating with the said first and second orifices, a portion of the second body member including said first orifice being slidably positioned inside the chamber in the first body member; and means cooperating with the first and second body members for substantially sealing said first orifice when said portion of the second body member including the first orifice is positioned inside the chamber in the first body member;

latching onto the equalizing blank valve apparatus with a wireline valve pulling tool;

jarring the equalizing blank valve apparatus upward with the wireline valve pulling tool so as to cause said first orifice to slide out of the chamber in said first body member.

11. A method as defined in claim 10 wherein the equalizing blank valve apparatus further comprises a shear screw passing through the first body member and engaging the second body member and wherein the jarring step comprises shearing said shear screw.

* * * * *